US009366473B2

(12) United States Patent
Bormann et al.

(10) Patent No.: US 9,366,473 B2
(45) Date of Patent: Jun. 14, 2016

(54) REFRIGERATION UNIT HAVING A CONTAINER

(71) Applicant: BSH HAUSGERÄTE GMBH, München (DE)

(72) Inventors: Marietta Bormann, Heidenheim (DE); Herbert Cizik, Ottenbach (DE); Jürgen Fink, Gerstetten (DE); Bernd Illenberger, Nattheim (DE); Thomas Kinzler, Dischingen (DE); Michael Krapp, Nattheim (DE); Markus Mayer, Königsbronn (DE); Robert Stahl, Herbrechtingen (DE)

(73) Assignee: BSH HAUSGERÄTE GMBH, München (DE)

( * ) Notice: Subject to any disclaimer, the term of this patent is extended or adjusted under 35 U.S.C. 154(b) by 0 days.

(21) Appl. No.: 14/764,773

(22) PCT Filed: Jan. 16, 2014

(86) PCT No.: PCT/EP2014/050761

§ 371 (c)(1),
(2) Date: Jul. 30, 2015

(87) PCT Pub. No.: WO2014/118005

PCT Pub. Date: Aug. 7, 2014

(65) Prior Publication Data

US 2015/0369530 A1 Dec. 24, 2015

(30) Foreign Application Priority Data

Jan. 31, 2013 (DE) ..... 10 2013 201 589

(51) Int. Cl.

| | |
|---|---|
| ***F25D 23/00*** | (2006.01) |
| ***F25D 23/06*** | (2006.01) |
| ***F25D 25/02*** | (2006.01) |

(52) U.S. Cl.
CPC ..... *F25D 23/067* (2013.01); *F25D 25/024* (2013.01); *F25D 25/025* (2013.01)

(58) Field of Classification Search
CPC ..... F25D 23/06; F25D 23/065; F25D 23/067; F25D 23/10; F25D 25/02; F25D 25/024; F25D 25/025; F25D 2325/021
USPC ..... 312/404, 408
See application file for complete search history.

(56) References Cited

U.S. PATENT DOCUMENTS 5,642,924 A * 7/1997 Wohlrab ..... A47B 57/16 211/134
5,893,620 A * 4/1999 Birgelis ..... F25D 23/067 312/334.44

(Continued)

FOREIGN PATENT DOCUMENTS

CN 102 278 864 12/2011
DE 89 09 402 9/1989

(Continued)

OTHER PUBLICATIONS

International Search Report for PCT/EP2014/050761, mailed Jul. 15, 2014, 4 pages.

(Continued)

*Primary Examiner* — Daniel Rohrhoff
(74) *Attorney, Agent, or Firm* — Nixon & Vanderhye P.C.

(57) ABSTRACT

The invention relates to a refrigeration unit having a refrigeration compartment in which a container is arranged, wherein a cover which can be seated in a guide contour is assigned to the container. According to the invention, the guide contour is integrated in an interior container wall of the refrigeration unit bordering the refrigeration compartment.

21 Claims, 8 Drawing Sheets

(56) References Cited

U.S. PATENT DOCUMENTS

Figure 1:
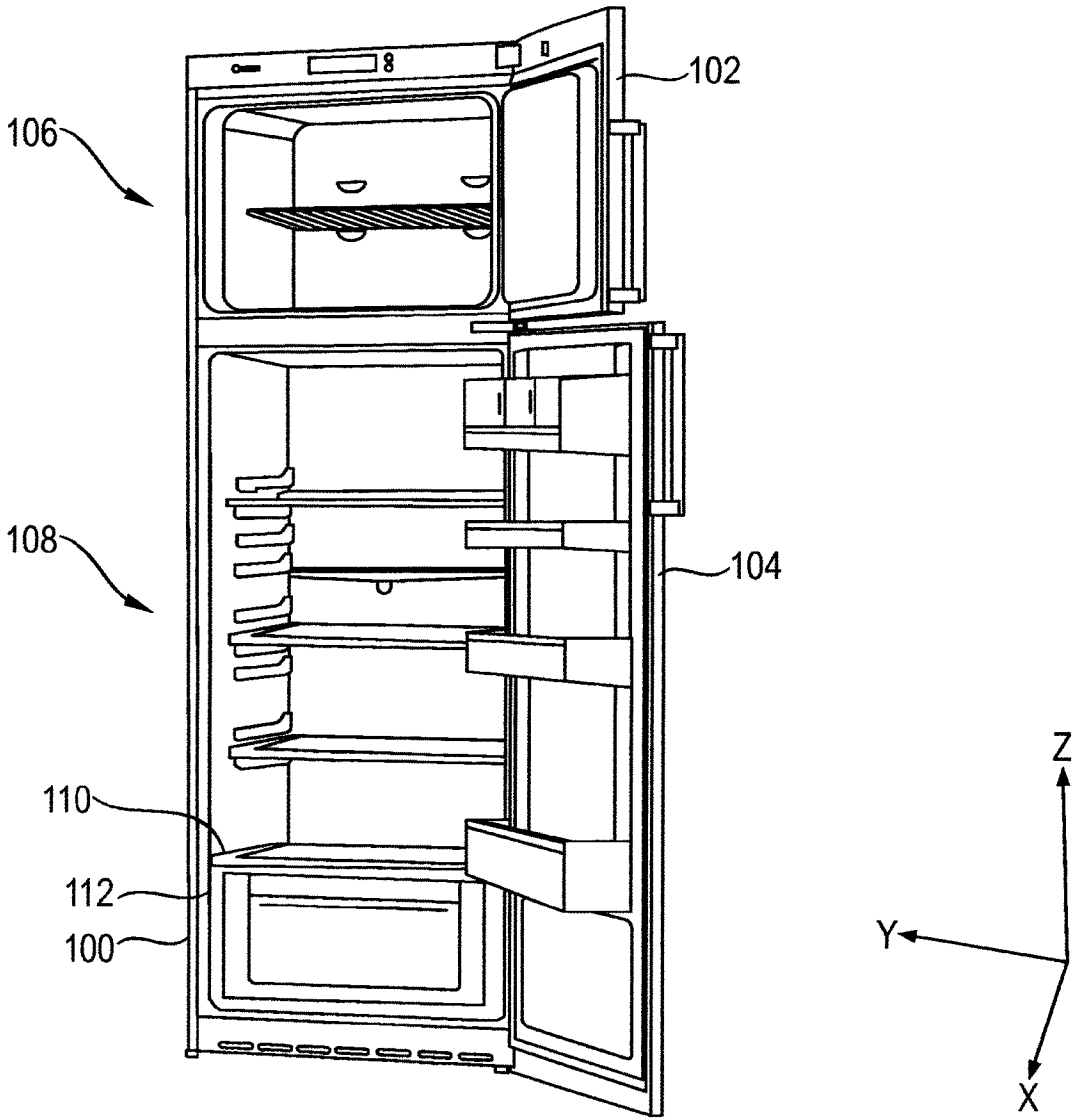

| | | | | |
|---|---|---|---|---|
| 2007/0210089 | A1* | 9/2007 | Kauk | B29C 44/16 220/592.1 |
| 2008/0191589 | A1* | 8/2008 | Dorner | A47B 88/044 312/116 |
| 2009/0206717 | A1* | 8/2009 | Koo | F25D 25/024 312/408 |
| 2010/0181884 | A1* | 7/2010 | De La Garza | F25D 25/024 312/408 |
| 2014/0117831 | A1* | 5/2014 | Lee | F25D 25/025 312/408 |
| 2015/0316314 | A1* | 11/2015 | Bassler | F25D 25/025 312/408 |

FOREIGN PATENT DOCUMENTS

| | | |
|---|---|---|
| DE | 11 2006 003890 | 4/2009 |
| DE | 20 2010 011132 | 11/2010 |
| EP | 0 365 936 | 5/1990 |
| JP | 45-687 | 1/1970 |
| JP | 57-108084 | 7/1982 |
| WO | WO 2007/139352 | 12/2007 |

OTHER PUBLICATIONS

Written Opinion of the ISA for PCT/EP2014/050761, mailed Jul. 15, 2014, 9 pages.

* cited by examiner

REFRIGERATION UNIT HAVING A CONTAINER

This application is the U.S. national phase of International Application No. PCT/EP2014/050761 filed 16 Jan. 2014 which designated the U.S. and claims priority to DE Patent Application No. 10 2013 201 589.5 filed 31 Jan. 2013, the entire contents of each of which are hereby incorporated by reference.

The invention relates to a refrigeration unit having a refrigeration compartment in which a container is arranged, wherein a cover which is displaceably mounted in a guide contour is assigned to the container.

Refrigeration units, in particular refrigeration units configured as domestic appliances, are known and are used for household management in the home or in the catering industry in order to store perishable foodstuffs and/or beverages at specific temperatures.

A refrigeration unit having a vegetable compartment is disclosed in DE 102009029139 A1. Since different foodstuffs require different levels of air humidity in order to maintain their freshness to an optimum degree, depending on the type of foodstuffs accommodated in the container it may be necessary to discharge humidity from the container to a greater or lesser extent. To this end, according to DE 102009029139 A1 the vegetable compartment is formed by a container which comprises a drawer and a cover, wherein the cover is height-adjustable between a position closing the drawer and an open position. The cover according to DE 102009029139 A1 is fastened to a horizontal plate serving as a shelf. Thus the shelf is necessary for the intended use of the container, the cover being fastened to said shelf.

It is, therefore, the object of the invention to provide a refrigeration unit which may be used in a more flexible manner.

This object is achieved by the subject of the invention having the features as claimed in the independent claim. Advantageous developments form the subject of the dependent claims, the description and the drawings.

The present invention is based on the recognition that a refrigeration unit may be used in a more flexible manner by such a container, if the cover is fastened to an inner container wall of the refrigeration unit.

According to a first feature, the object according to the invention is achieved by a refrigeration unit in which the guide contour is integrated in an inner container wall of the refrigeration unit defining the refrigeration compartment. As a result, the technical advantage is achieved that the cover is fastened to the inner container wall of the refrigeration unit and thus a use of the container with the displaceable cover is possible even without the shelf being inserted into the refrigeration compartment. The flexibility is increased thereby.

A "refrigeration unit" is understood, in particular, as a domestic appliance, i.e. a refrigeration unit which is used for household management in the home or in the catering field and, in particular, serves to store foodstuffs and/or beverages at specific temperatures, such as for example a refrigerator, an upright freezer, a refrigerator/freezer combination, a chest freezer or a wine cooler.

In an advantageous embodiment, a shelf support in the refrigeration compartment of the refrigeration unit has a support surface for a shelf and the guide contour is integrated in the support surface. As a result, the technical advantage is achieved that the support surface has a dual function, namely to provide a support surface for the shelf and to form the guide contour. Thus a particularly simple design of the refrigeration unit is provided.

In a further embodiment, the guide contour is formed by a recessed portion. As a result, the technical advantage is achieved that the recesses in the support surface are closed by a shelf bearing against the shelf support and thus the hooks of the cover which engage in the guide contour are prevented from coming out of engagement in an undesirable manner. The operating safety is increased thereby.

In a further advantageous embodiment, the guide contour has two recessed portions arranged at a distance from one another. As a result, the technical advantage is achieved that the cover may be displaced by the guide contour, opening up a uniform peripheral edge for optimal ventilation.

In a further advantageous embodiment, the distance extends in the direction of the depth of the refrigeration unit. As a result, the technical advantage is achieved that the guide contour may be arranged on a side wall portion of the inner container wall of the refrigeration unit. As a result, a particularly simple design is provided.

In a further advantageous embodiment, the distance is shorter than the length of the floor support in its main direction of extent. As a result, the technical advantage is achieved that the floor support has a large support surface for the secure mounting of a shelf so that even heavy refrigerated goods may be stored on the shelf.

In a further advantageous embodiment, the guide contour is arranged on the lower face of a floor support with a support surface for a shelf. As a result, the technical advantage is achieved that a shelf support with a support surface for a shelf remains unaltered in turn. Thus a refrigeration unit with a particularly simple design is provided.

In a further advantageous embodiment, the guide contour is formed by a positive indentation. As a result, the technical advantage is achieved that no storage space in the refrigeration compartment of the container is taken up by the guide contour, nor is the storage space reduced. Thus a refrigeration unit is provided with maximum storage space in the refrigeration compartment.

In a further advantageous embodiment, a guide contour element of the guide contour is arranged without spacing on the shelf support. As a result, the technical advantage is achieved that the inner container wall is shaped only in the region of the shelf support and the guide contour, whilst other portions of the container wall remain unaltered. As a result, a refrigeration unit with a visually attractive inner container wall is provided.

In a further advantageous embodiment, the guide contour is integrated in the shelf support. As a result, the technical advantage is achieved that the shelf support has a dual function, namely to provide a support surface for the shelf and to provide a guide contour for the cover. As a result, a refrigeration unit with a particularly simple design is provided.

In a further advantageous embodiment, the guide contour has two guide contour elements arranged at a distance from one another. As a result, the technical advantage is achieved that the cover may be displaced by the guide contour, opening up a uniform peripheral edge for optimal ventilation.

In a further advantageous embodiment, the distance extends in the direction of the depth of the refrigeration unit. As a result, the technical advantage is achieved that the guide contour may be arranged on a side wall portion of the inner container wall of the refrigeration unit. As a result, a particularly simple design is provided.

In a further advantageous embodiment, the distance is shorter than the length of the shelf support in its main direction of extent. As a result, the technical advantage is achieved that the floor support has a larger support surface for the secure mounting of a shelf so that even heavy refrigerated goods may be stored on the shelf.

In a further advantageous embodiment, the guide contour has a first vertical-adjustment portion and a second vertical-adjustment portion. As a result, the technical advantage is achieved that the cover may be moved to different heights by the first and second vertical-adjustment portions and thereby variably spaced apart from the container so that a variable level of ventilation of the container is possible by means of the two vertical-adjustment portions.

According to a second feature, the object according to the invention is achieved by a container for such a refrigeration unit. As a result, the technical advantage is achieved that the cover is fastened to the inner container wall of the refrigeration unit and thus a use of the container is possible with the displaceable cover even without the shelf inserted into the refrigeration compartment. The flexibility is increased thereby.

Figure 2:
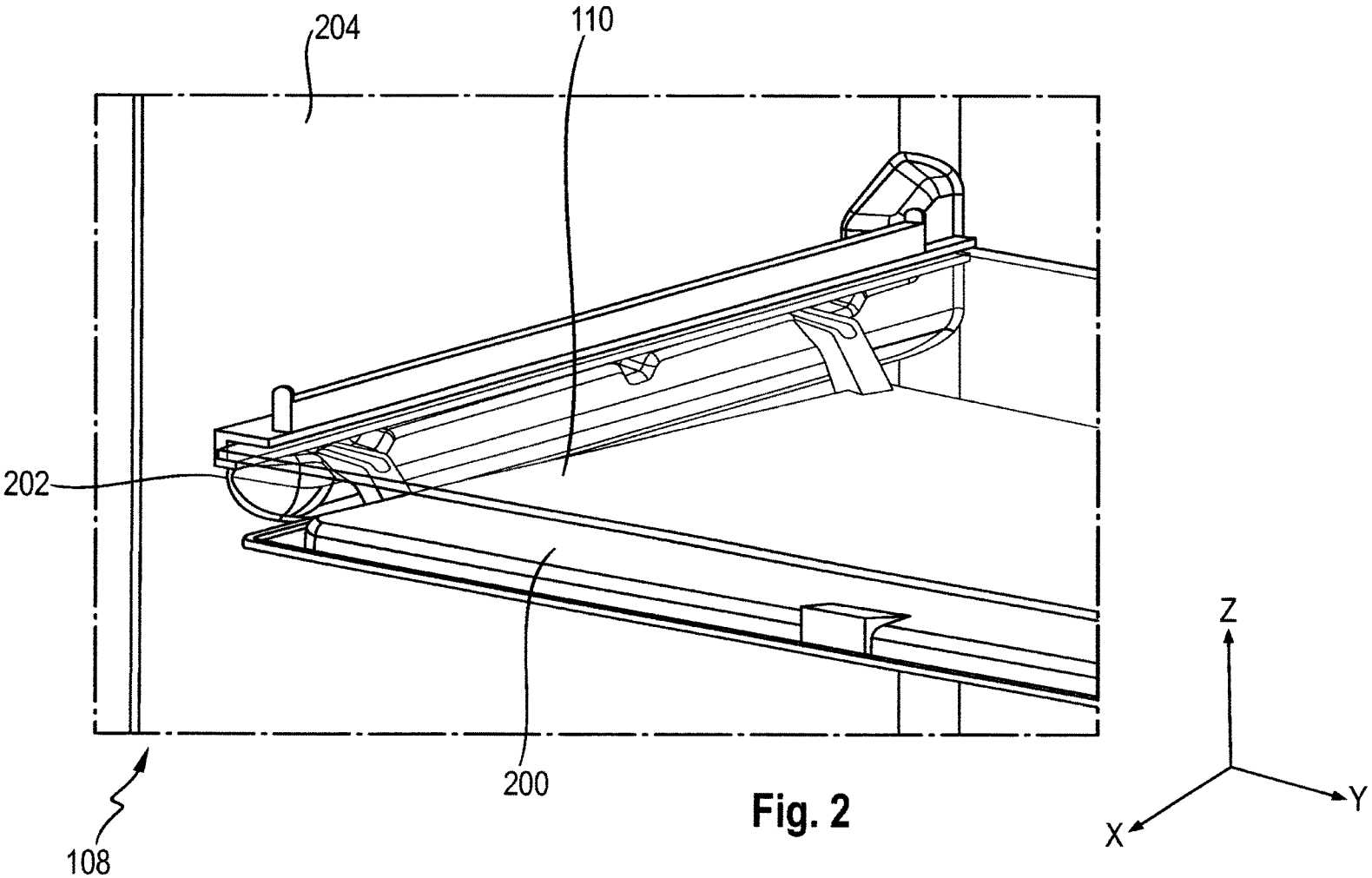
Figure 3:
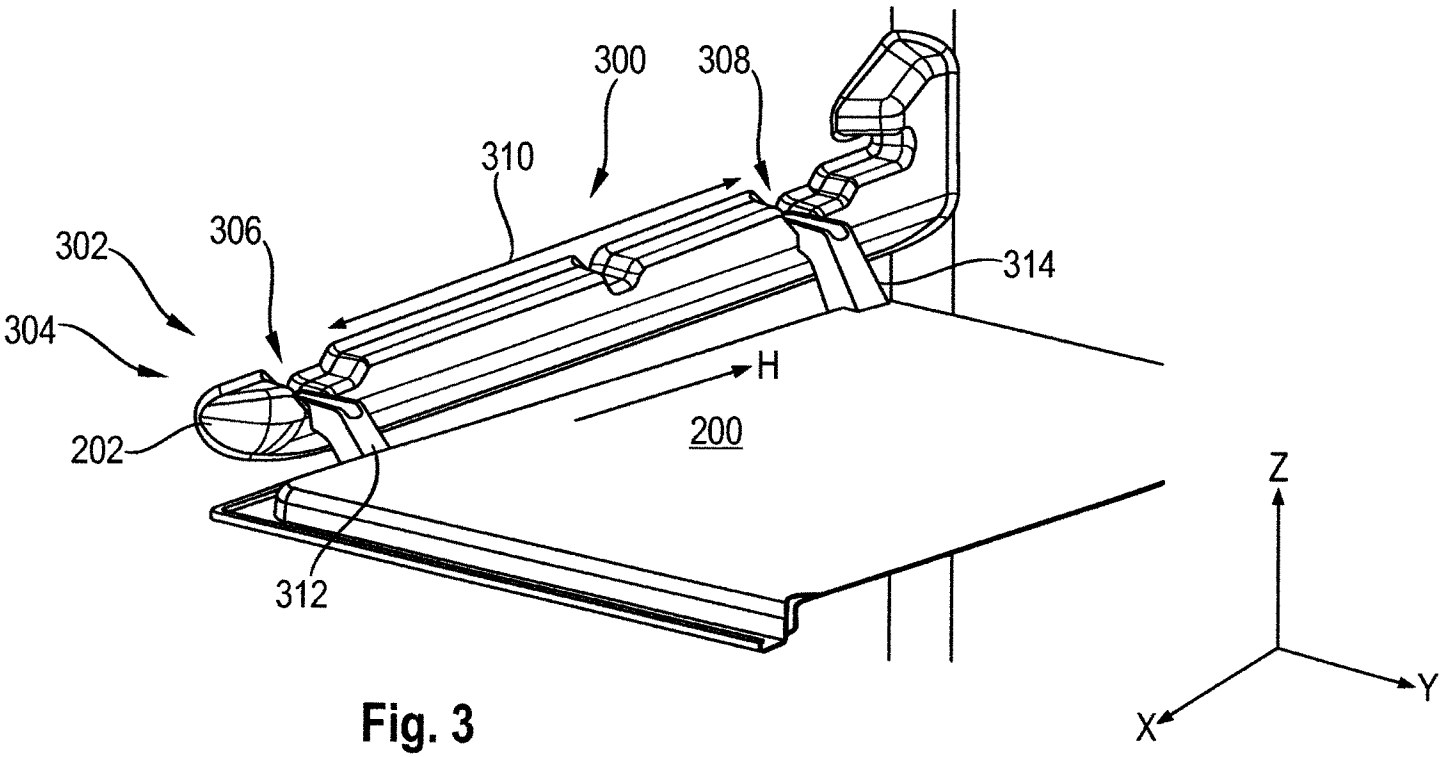
Figure 4:
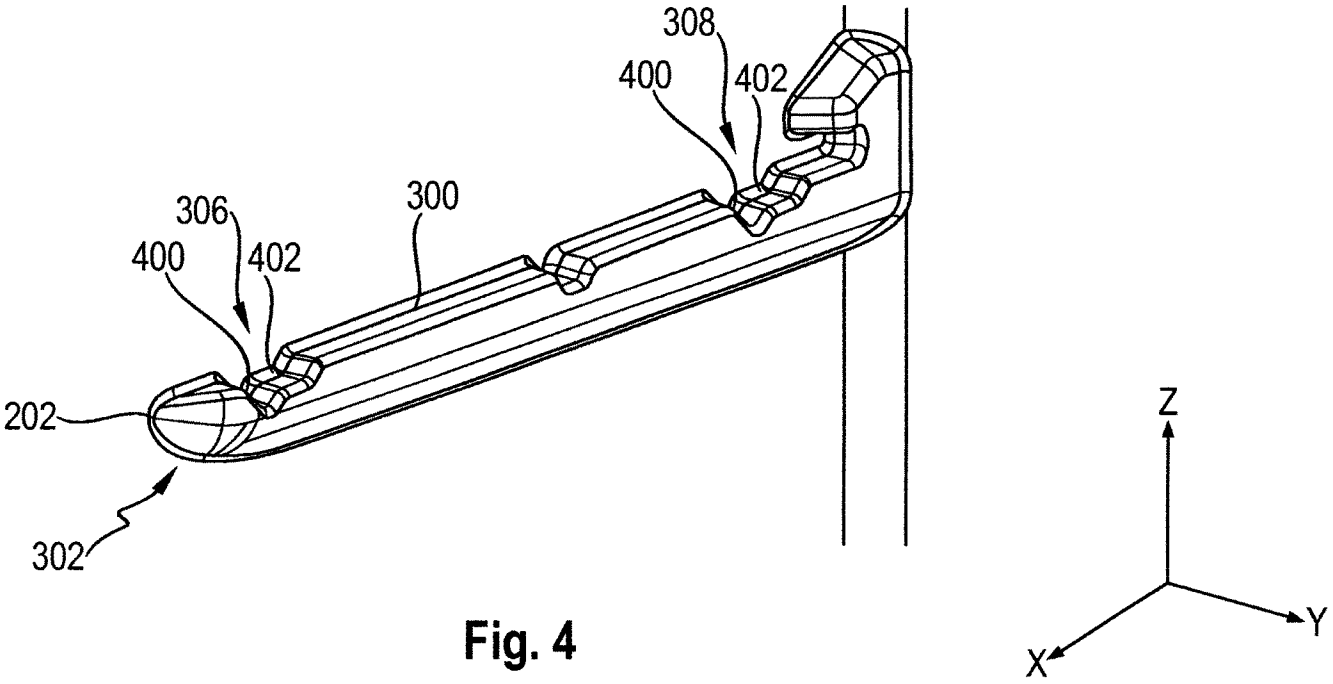
Figure 5:
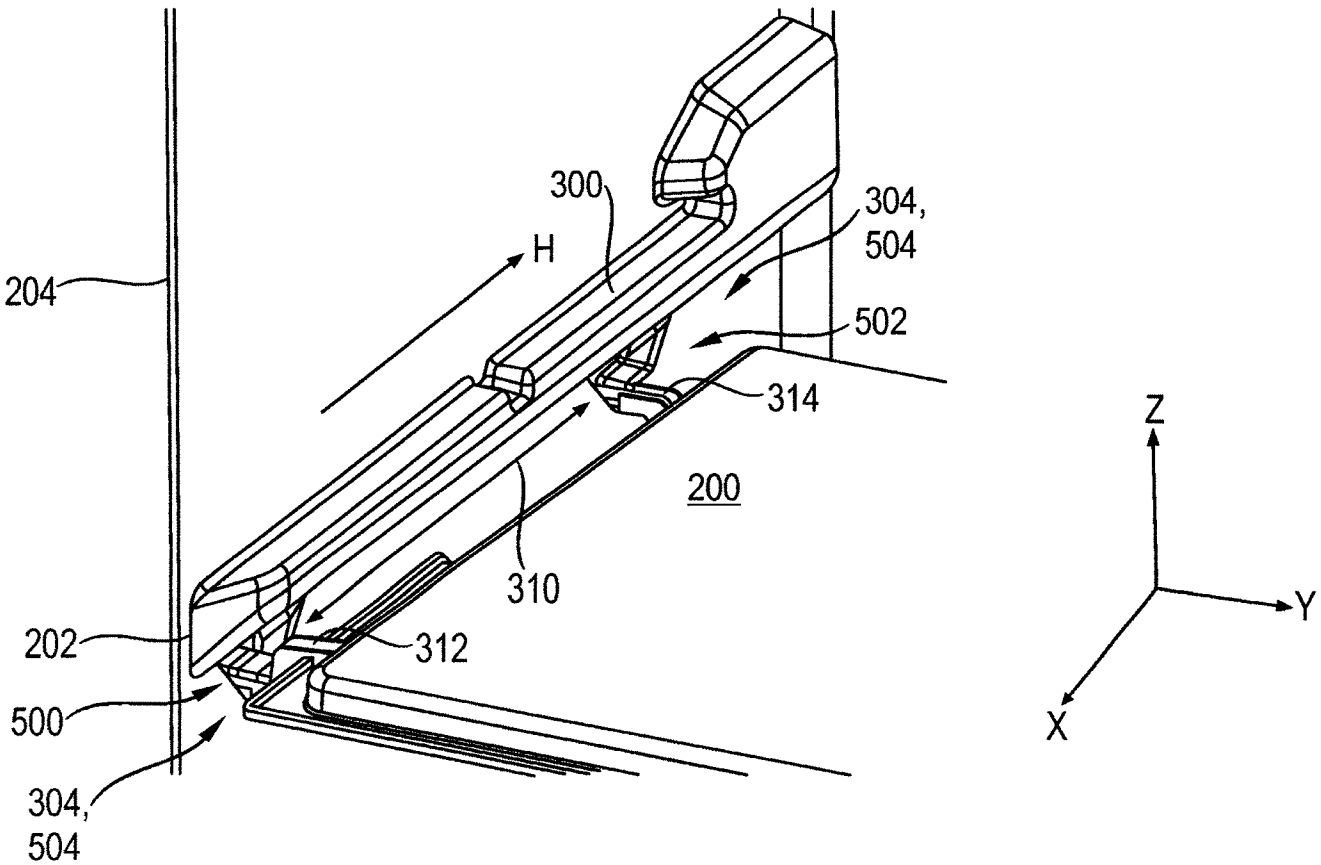
Figure 6:
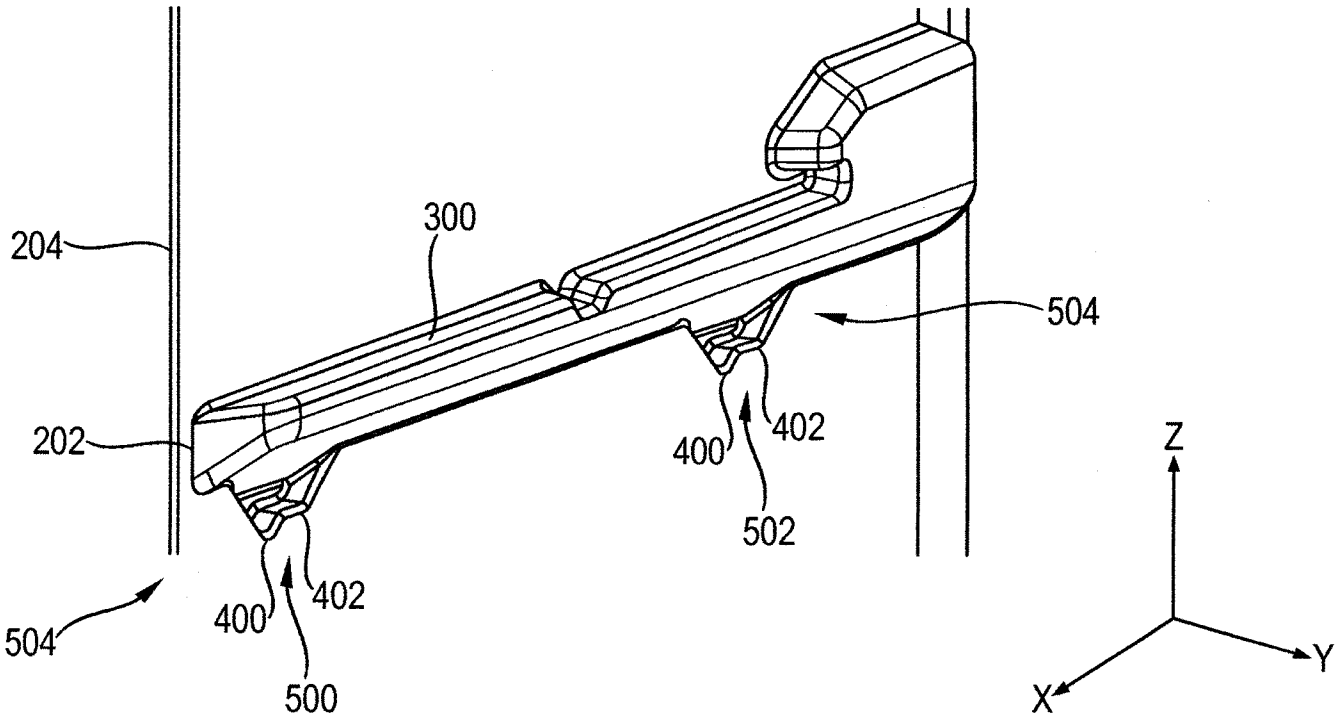
Figure 7:
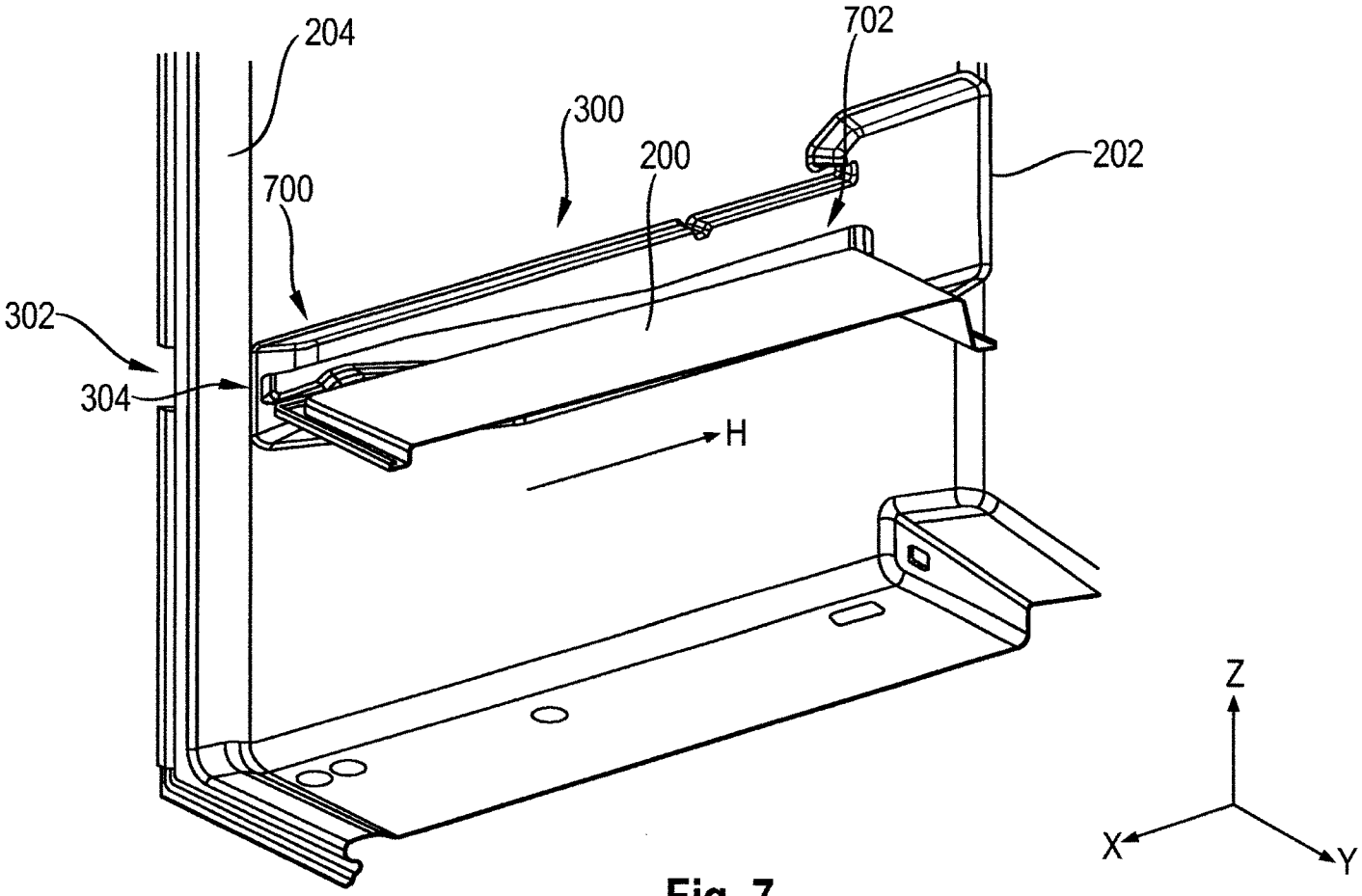
Figure 8:
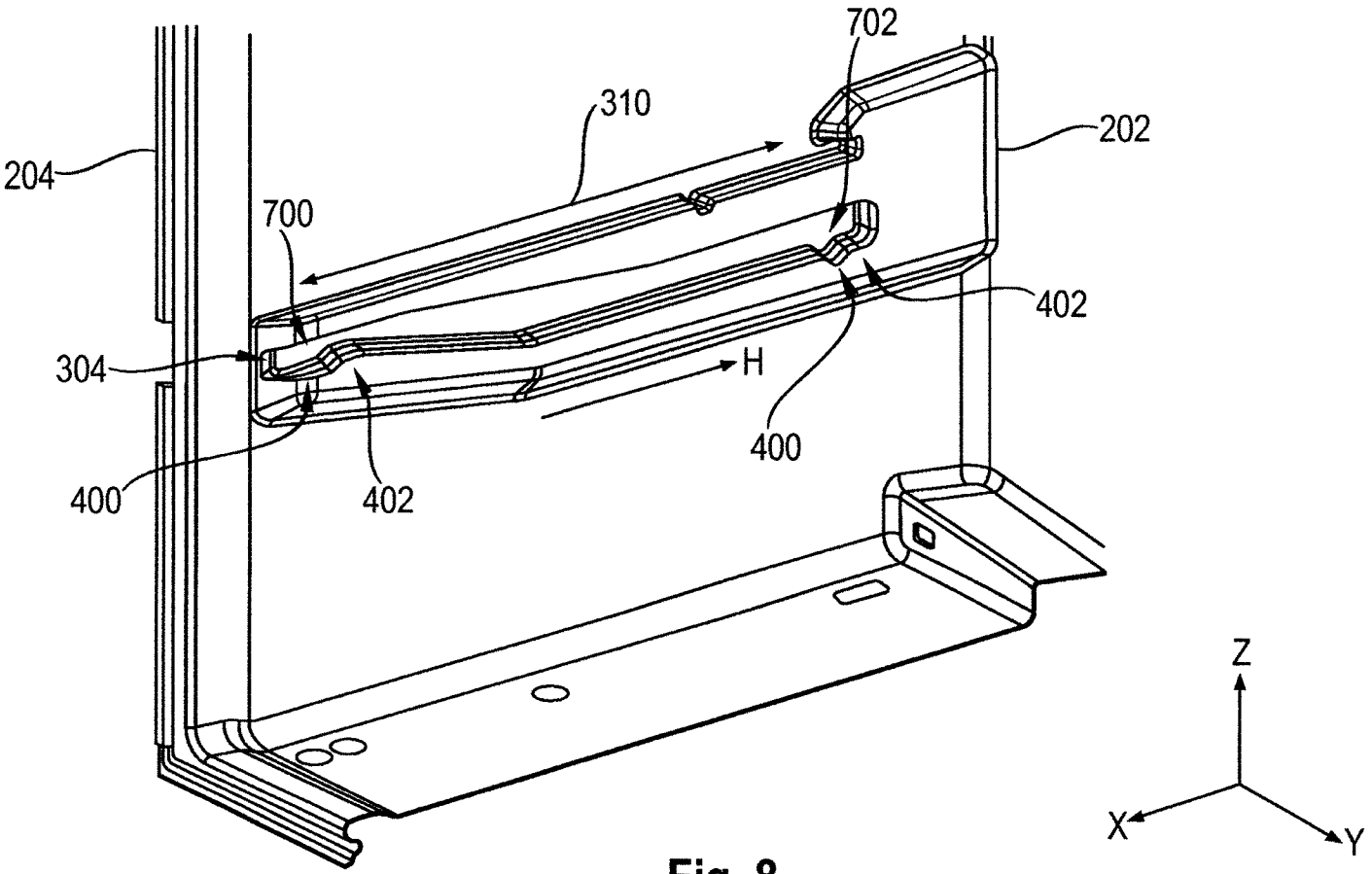

Further exemplary embodiments are described with reference to the accompanying drawings, in which:

FIG. 1 shows a front view of a refrigeration unit,

FIG. 2 shows a perspective view of a first exemplary embodiment of a guide contour with the shelf in position and the cover hooked on, FIG. 3 shows a further perspective view of the first exemplary embodiment shown in FIG. 1 but without the shelf in position, FIG. 4 shows a further perspective view of the first exemplary embodiment shown in FIG. 1 but without the shelf in position and without the cover hooked on, FIG. 5 shows a second exemplary embodiment of a guide contour with the cover hooked on, FIG. 6 shows a further perspective view of the second exemplary embodiment shown in FIG. 5 but without the cover hooked on, FIG. 7 shows a third exemplary embodiment of a guide contour with the cover hooked on and FIG. 8 shows a further perspective view of the third exemplary embodiment shown in FIG. 7 but without the cover hooked on.

FIG. 1 shows a refrigerator as an exemplary embodiment for a refrigeration unit 100 with an upper refrigerator door 102 and a lower refrigerator door 104 on its refrigeration unit front face. The refrigerator serves, for example, for cooling foodstuffs and comprises a coolant circuit with an evaporator (not shown), a condenser (not shown), a liquefier (not shown) and a throttle member (not shown).

The evaporator is configured as a heat exchanger in which, after expansion, the liquid coolant is evaporated by the absorption of heat from the medium to be cooled, i.e. air in the interior of the refrigerator.

The condenser is a mechanically driven component which draws in coolant vapor from the evaporator and discharges it to the liquefier at a higher pressure.

The liquefier is configured as a heat exchanger in which, after compression, the evaporated coolant is liquefied by the discharge of heat to an external coolant, i.e. the surrounding air.

The throttle member is a device for continuously reducing the pressure by cross-sectional reduction.

The coolant is a fluid which is used for the transmission of heat in the system producing cold, which absorbs heat at low temperatures and at a low pressure of the fluid and discharges heat at a higher temperature and higher pressure of the fluid, wherein state alterations of the fluid are generally involved.

An upper refrigeration compartment 106 may be opened by means of the upper refrigeration unit door 102, said upper refrigeration compartment in the present exemplary embodiment being configured as a refrigeration compartment. A lower refrigeration compartment 108 may be opened by means of the lower refrigeration unit door 104, said lower refrigeration compartment in the present exemplary embodiment being configured as a refrigeration compartment.

In the present exemplary embodiment, four shelves 110 are arranged in the lower refrigeration compartment 108, only one shelf thereof having been provided with the reference numeral 110 for reasons of simplicity.

In the present exemplary embodiment, the shelf 110 is made from glass.

A container 112 is arranged below the shelf 110 in the lower refrigeration compartment 108, in the present exemplary embodiment the shelf being configured as a vegetable box. In the present exemplary embodiment, the container is made from a plastic material.

FIG. 2 shows a portion of an inner container wall 204 which defines the lower refrigeration compartment 108. In the present exemplary embodiment, the inner container wall 204 is configured as a side wall.

In the present exemplary embodiment, a shelf support 202 is integrated into the inner container wall 204, in the present exemplary embodiment the shelf 110 resting on said shelf support.

In the present exemplary embodiment, a cover 200 is arranged below the shelf 110 in the direction of the height of the refrigeration unit Z, the cover being able to adopt two different vertical positions in order to permit variable ventilation of the container 112 as described hereinafter.

FIG. 3 shows that in the present exemplary embodiment the floor support 202 is configured as a floor support rib. In the present exemplary embodiment, the floor support rib has a main direction of extent H which extends in the direction of the depth of the refrigeration unit X. In the present exemplary embodiment, the shelf support 202 is formed by a negative indentation 302 of the inner container wall 204.

Thus in the present exemplary embodiment, the shelf support 202 is configured integrally with the inner container wall 204.

In the present exemplary embodiment, the shelf support 202 has a support surface 300, the shelf 110 being supported thereon as shown in FIG. 2. The support surface 300 extends in the present exemplary embodiment in the direction of the depth of the refrigeration unit X and in the present exemplary embodiment is interrupted by a front recessed portion 306 in the direction of the depth of the refrigeration unit X and a rear recessed portion 308 in the direction of the depth of the refrigeration unit X, which in the present exemplary embodiment together form a guide contour 304. Thus in the present exemplary embodiment, the guide contour 304 is integrated in the support surface 300.

In this case, in the present exemplary embodiment the front recessed portion 306 and the rear recessed portion 308 are arranged spaced apart from one another by a distance 310. The distance 310 is in this case shorter than the length of the support surface 300 in the main direction of extent H and/or the direction of the depth of the refrigeration unit X.

A front hook 312 of the cover 200 in the direction of the depth of the refrigeration unit X engages in the front recessed portion 306 of the guide contour 304 and a rear hook 314 of the cover 200 in the direction of the depth of the refrigeration unit X engages in the rear recessed portion 308 of the guide contour 304.

FIG. 4 shows that in the present exemplary embodiment the front recessed portion 306 has a first vertical-adjustment portion 400 and a second vertical-adjustment portion 402. Moreover, in the present exemplary embodiment the rear recessed portion 308 has a first vertical-adjustment portion 400 and a second vertical-adjustment portion 402. In this case, in the present exemplary embodiment the two first vertical-adjustment portions 400 are configured as V-shaped notches whilst the two second vertical-adjustment portions 402 are of plate-shaped configuration.

By displacing the front hook 312 and the rear hook 314 from the respective first vertical-adjustment portions 400 to the respective second vertical-adjustment portions 402, and vice versa in the direction of the depth of the refrigeration unit X, a displacement of the cover 200 in the direction of the height of the refrigeration unit Z may be effected, whereby a peripheral gap is formed between the cover 200 and the container 112 which ensures optimal ventilation of the refrigerated goods stored in the container 112.

FIG. 5 also shows a shelf support 202 which is configured as a floor support rib. Moreover, in the present exemplary embodiment the shelf support 202 is integrally formed on the inner container wall 204 which is configured as a side wall. Thus, in the present exemplary embodiment the shelf support 202 is integrally configured with the inner container wall 204. This shelf support 202 also has a support surface 300 for the shelf 200.

Also in this exemplary embodiment, the support surface 300 has a main direction of extent H which coincides with the direction of the depth of the refrigeration unit X.

In the present exemplary embodiment, the guide contour 304 is arranged without spacing, adjacent to the shelf support 202 below the shelf support 202. Thus the guide contour is arranged on the lower face of the shelf support 202.

In the present exemplary embodiment, the guide contour 304 is formed by a positive indentation 504 of the inner container wall 204. In the present exemplary embodiment, it comprises a front recessed portion 306 in the direction of the depth of the refrigeration unit X and a rear guide contour element 502 in the direction of the depth of the refrigeration unit X. In the present exemplary embodiment, the front hook 312 engages in the front guide contour element 500 and the rear hook 314 of the cover 200 engages in the rear guide contour element 502.

In this case, in the present exemplary embodiment the front guide contour element 500 and the rear guide contour element 502 are arranged spaced apart from one another by the distance 310. The distance 310 extends in the main direction of extent H of the support surface 300 and/or in the direction of the depth of the refrigeration unit X.

FIG. 6 shows that the front guide contour element 500 has a first vertical-adjustment portion 400 and a second vertical-adjustment portion 402. Moreover, FIG. 6 shows that the rear guide contour element 502 has a first vertical-adjustment portion 400 and a second vertical-adjustment portion 402.

Also in this exemplary embodiment, the first vertical-adjustment portions 400 are configured as V-shaped notches, whilst the second vertical-adjustment portions 402 are of plate-shaped configuration.

By displacing the front hook 312 and the rear hook 314 from the respective first vertical-adjustment portions 400 to the respective second vertical-adjustment portions 402, and vice versa in the direction of the depth of the refrigeration unit X, a displacement of the cover 200 in the direction of the height of the refrigeration unit Z may be effected, whereby a peripheral gap is formed between the cover 200 and the container 112 which ensures optimal ventilation of the refrigerated goods stored in the container 112.

FIG. 7 shows a further exemplary embodiment of a shelf support 202 with a support surface 300 for the shelf 110, which is configured as a shelf support 202. Also in this exemplary embodiment, the floor support rib has a main direction of extent H which extends toward the direction of the depth of the refrigeration unit X. In the present exemplary embodiment, the shelf support 202 is formed by a negative indentation 302 of the inner container wall 204.

The shelf support 202 in this exemplary embodiment is integrally formed on an inner container wall 204 of the refrigeration unit 100 which is configured as a side wall. Thus, in the present exemplary embodiment the shelf support 202 is integrally formed with the inner container wall 204.

However, in the present exemplary embodiment the shelf support 202 is configured so as to be extended in the direction of the height of the refrigeration unit Z, in contrast to the previous exemplary embodiments. In this exemplary embodiment, the guide contour 304 is integrated in the shelf support 202.

In this exemplary embodiment, the guide contour 304 comprises a front guide portion 700 in the direction of the depth of the refrigeration unit X and a rear guide portion 702 in the direction of the depth of the refrigeration unit X, which in the present exemplary embodiment are arranged centrally in the shelf support 202 in the direction of the height of the refrigeration unit Z.

FIG. 8 shows that in the present exemplary embodiment the front guide portion 700 and the rear guide portion 702 are arranged spaced apart from one another by the distance 310. Also in this exemplary embodiment the distance 310 is shorter than the length of the support surface 300 in the main direction of extent H and/or direction of the depth of the refrigeration unit X.

In the present exemplary embodiment, the front guide portion 700 has a first vertical-adjustment portion 400 and a second vertical-adjustment portion 402. Moreover, in the present exemplary embodiment, the rear guide portion 702 has a first vertical-adjustment portion 400 and a second vertical-adjustment portion 402.

Also in this exemplary embodiment, the first vertical-adjustment portions 400 are configured as V-shaped notches, whilst the second vertical-adjustment portions 402 are of plate-shaped configuration.

By displacing the front hook 312 and the rear hook 314 from the respective first vertical-adjustment portions 400 toward the respective second vertical-adjustment portions 402 and vice versa in the direction of the depth of the refrigeration unit X, a displacement of the cover 200 in the direction of the height of the refrigeration unit Z may be effected, whereby a peripheral gap is formed between the cover 200 and the container 112 which ensures optimal ventilation of the refrigerated goods stored in the container 112.

LIST OF REFERENCE NUMERALS

100 Refrigeration unit
102 Upper refrigeration unit door
104 Lower refrigeration unit door
106 Upper refrigeration compartment
108 Lower refrigeration compartment
110 Shelf
112 Container
200 Cover
202 Shelf support
204 Inner container wall
300 Support surface
302 Negative indentation
304 Guide contour
306 Front recessed portion

308 Rear recessed portion
310 Distance
312 Front hook
314 Rear hook
400 First vertical-adjustment portion
402 Second vertical-adjustment portion
500 Front guide contour element
502 Rear guide contour element
504 Positive indentation
700 Front guide portion
702 Rear guide portion
H Main direction of extent
X Direction of the depth of the refrigeration unit
Y Direction of the width of the refrigeration unit
Z Direction of the height of the refrigeration unit

The invention claimed is:

1. A refrigeration unit having a refrigeration compartment in which a container is arranged, wherein a cover which is displaceably mounted in a guide contour is assigned to the container, wherein the guide contour is integrated in an inner container wall of the refrigeration unit defining the refrigeration compartment;

wherein the cover is positioned above the container and is vertically movable within the guide contour to permit variable ventilation of the container.

2. The refrigeration unit as claimed in claim 1, wherein a shelf support in the refrigeration compartment of the refrigeration unit has a support surface for a shelf and the guide contour is integrated in the support surface.

3. The refrigeration unit as claimed in claim 1, wherein the guide contour is formed by a recessed portion.

4. The refrigeration unit as claimed in claim 3, wherein the guide contour has two recessed portions arranged at a distance from one another.

5. The refrigeration unit as claimed in claim 4, wherein the distance extends in the direction of the depth of the refrigeration unit.

6. The refrigeration unit as claimed in claim 4, wherein the distance is shorter than the length of the shelf support in its main direction of extent.

7. The refrigeration unit as claimed in claim 1, wherein the guide contour is arranged on the lower face of a shelf support with a support surface for a shelf.

8. The refrigeration unit as claimed in claim 7, wherein the guide contour is formed by a positive indentation.

9. The refrigeration unit as claimed in claim 7, wherein a guide contour element of the guide contour is arranged without spacing on the shelf support.

10. The refrigeration unit as claimed in claim 1, wherein the guide contour is integrated in the shelf support.

11. The refrigeration unit as claimed in claim 10, wherein the guide contour has two guide portions arranged at a distance from one another.

12. The refrigeration unit as claimed in claim 11, wherein the distance extends in the direction of the depth of the refrigeration unit.

13. The refrigeration unit as claimed in claim 11, wherein the distance is shorter than the length of the shelf support in its main direction of extent.

14. The refrigeration unit as claimed in claim 1, wherein the guide contour has a first vertical-adjustment portion and a second vertical-adjustment portion.

15. A container for a refrigeration unit as claimed in claim 1.

16. A container for a refrigeration unit as claimed in claim 1, wherein the cover is movable within the guide portion between a first position and a second position, and wherein movement to the second position results in a peripheral gap to provide ventilation to the container.

17. A container for a refrigeration unit as claimed in claim 1, further comprising a shelf positioned above the cover, wherein the cover is vertically displaceable within the guide portion relative to the container.

18. A container for a refrigeration unit as claimed in claim 17, wherein the cover and the shelf are independently attached to the guide portion.

19. A refrigeration unit comprising:

a refrigeration compartment;

a container retractably arranged in the compartment;

a cover to cover the container, the cover being movable relative to the container to control ventilation of the container;

a shelf positioned above the cover; and an integrated guide contour integrated into a wall of the compartment, the guide contour including a shelf support to support the shelf and at least one cover support surface to support the cover in a heightwise adjustable manner.

20. A refrigeration unit as claimed in claim 19, wherein the cover support surface includes a first support surface to support the cover in a first vertical position and a second support surface to support the cover in a second vertical position that allows ventilation of the container.

21. A refrigeration unit as claimed in claim 20, wherein the cover is movable in a horizontal direction to move the cover between the first and second vertical positions.

* * * * *